US008297174B1

(12) United States Patent
Russell et al.

(10) Patent No.: US 8,297,174 B1
(45) Date of Patent: Oct. 30, 2012

(54) APPARATUS AND METHOD FOR GUN RECOIL MITIGATION

(75) Inventors: Kevin Russell, Jersey City, NJ (US); Eric Binter, Sussex, NJ (US); Adam Jacob, Brodheadsville, PA (US); Hansen Lukman, Parsippany, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 312 days.

(21) Appl. No.: 12/607,164

(22) Filed: Oct. 28, 2009

Related U.S. Application Data

(60) Provisional application No. 61/120,954, filed on Dec. 9, 2008.

(51) Int. Cl.
*F41A 23/00* (2006.01)

(52) U.S. Cl. ..... 89/42.01; 89/44.01; 89/37.14

(58) Field of Classification Search ..... 42/1.06; 89/37.08, 37.14, 42.03, 44.01, 44.02, 42.01
See application file for complete search history.

(56) References Cited

U.S. PATENT DOCUMENTS

| | | | | |
|---|---|---|---|---|
| 789,806 | A * | 5/1905 | Haussner | 89/44.01 |
| 1,059,093 | A * | 4/1913 | Voller | 89/43.01 |
| 4,524,671 | A * | 6/1985 | Bender et al. | 89/14.05 |
| 5,585,590 | A * | 12/1996 | Ducolon | 89/42.01 |
| 7,895,930 | B2 * | 3/2011 | Fisk et al. | 89/1.1 |

* cited by examiner

*Primary Examiner* — Daniel Troy
(74) *Attorney, Agent, or Firm* — Henry S. Goldfine

(57) ABSTRACT

A weapon may include a translatable recoil mass and two translatable counterweights disposed on opposite sides of the recoil mass. Each counterweight may have a mass that is substantially one-half a mass of the recoil mass. A pair of racks may be fixed to respective ones of the counterweights and a second pair of racks may be fixed to opposites sides of the recoil mass. Pinions may engage the counterweight and recoil mass racks. A receiver may be fixed with respect to the recoil mass and the pair of counterweights. The directions of translation of the recoil mass are substantially opposite directions of translation of the two counterweights.

3 Claims, 4 Drawing Sheets

APPARATUS AND METHOD FOR GUN RECOIL MITIGATION

CROSS-REFERENCE TO RELATED APPLICATIONS

This application claims the benefit under 35 USC 119(e) of U.S. provisional patent application 61/120,954 filed on Dec. 9, 2008, which is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates, in general, to munitions, and, in particular, to the mitigation of recoil in weapons.

Conventional methods for mitigating weapon recoil in small arms may include muzzle brakes, breech venting, improved buttstock designs, improved buffer designs and bolt/slide designs that redirect bolt momentum. Because both gas venting momentum and operating group momentum may contribute to recoil, the conventional recoil mitigation methods may, at best, only partially mitigate recoil. Partial mitigation of recoil may occur because the conventional methods do not address both the momentum produced by venting gases and the momentum produced by the operating group. Thus, a need exists for an apparatus and method to mitigate recoil caused by both gas venting momentum and operating group momentum.

SUMMARY OF THE INVENTION

It is an object of the invention to provide a mechanism to mitigate recoil in a weapon.

It is another object of the invention to provide a mechanism to mitigate recoil caused by both gas venting momentum and operating group momentum.

One aspect of the invention may be a weapon having a translatable recoil mass and two translatable counterweights disposed on opposite sides of the recoil mass. Each counterweight may have a mass that is substantially one-half the mass of the recoil mass. The directions of translation of the recoil mass may be substantially opposite the directions of translation of the two counterweights. The translatable recoil mass may include a barrel and barrel block.

The weapon may further include a pair of racks fixed to respective ones of the counterweights, a second pair of racks fixed to opposite sides of the translatable recoil mass, and a pair of pinions. Each pinion may engage a counterweight rack and a translatable recoil mass rack.

Another aspect of the invention may be a method of mitigating recoil in a weapon. The method may include moving a pair of counterweights in a direction substantially opposite a direction of movement of a recoil mass. The pair of counterweights may each have a mass that is about one-half a mass of the recoil mass. The counterweights and the recoil mass may move at substantially the same speed. The method may include controlling movement of the counterweights and the recoil mass using pinions that engage racks on the counterweights and the recoil mass.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A kinematic chain may alleviate weapon recoil by canceling (by way of opposing counterweight momentum) some or all of the momentum generated in a translating barrel during firing. A kinematic chain that includes a translating barrel block and momentum-canceling counterweights may mitigate both gas venting momentum and operating group momentum, simultaneously. The kinematic chain may be used in weapons of any caliber, for example, from small arm calibers to artillery calibers.

Figure 1:
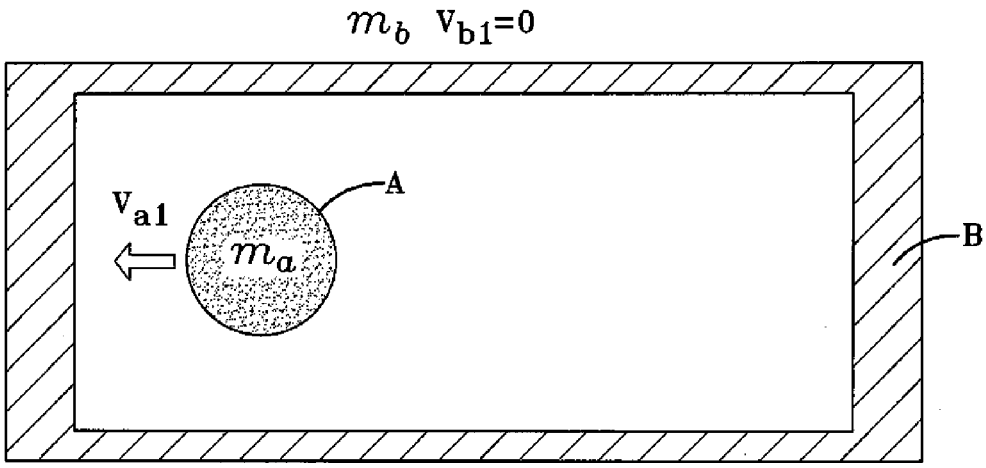
FIG. 1 is a schematic view of a ball traveling in a box without counterweights.

The momentum P of a body is the product of the mass m and velocity v of the body (P=mv). FIG. 1 illustrates a ball A traveling within a box B. The box B is initially at rest. Therefore $v_{B1}=0$ in FIG. 1. According to the conservation of momentum principle, the momentum of the ball/box system before impact ($P_1=m_A v_{A1}+m_B v_{B1}$) is equal to the momentum of the system after impact ($P_2=m_A v_{A2}+m_B v_{B2}$). The quantity ($m_B v_{B1}$) is zero. After the ball A strikes the box B, velocity and, subsequently, momentum is transferred to the box B. Thus, the velocity of box B after impact is $v_{B2}=(m_A/m_B)(v_{A1}+v_{A2})$.

Figure 2:
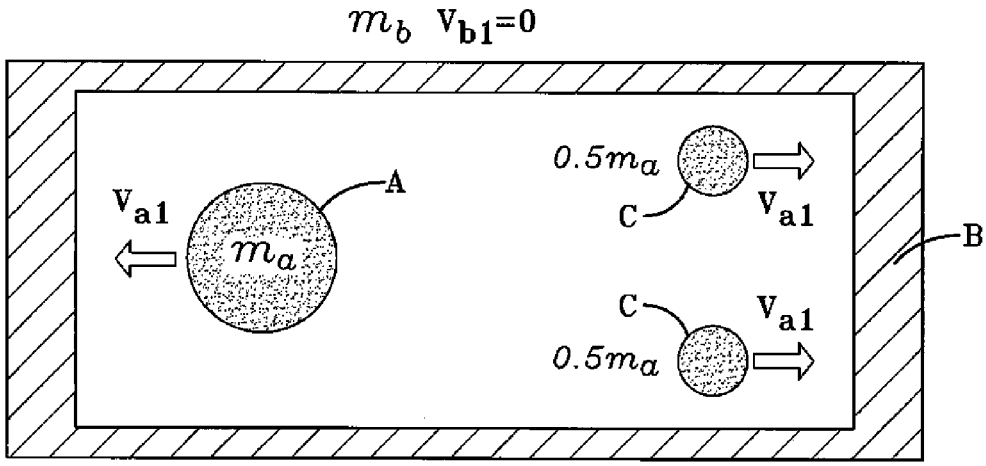
FIG. 2 is a schematic view of a ball traveling in a box with counterweights.

In FIG. 2, two smaller balls C, C each have a mass equal to one half the mass of the ball A. The two smaller balls C, C travel in the opposite direction of the larger ball A, but at the same speed as the larger ball A. The momentum of the ball/box system before impact ($P_1=m_A v_{A1}-m_A v_{A1}+m_B v_{B1}$) is equal to zero and is equal to the momentum of the system after impact ($P_2=m_A v_{A2}-m_A v_{A2}+m_B v_{B2}$). Under this condition, the momenta of the traveling balls A, C, C cancel each other upon impact. No velocity and, consequently, no momentum are transferred to the box B after impact. Thus, $v_{B2}=0$.

The box B may represent a weapon's receiver, the ball A may represent the weapon's barrel, and the balls C, C may represent the weapon's operating group. Under certain conditions, no momentum may be transferred to the weapon's receiver B and, ultimately, the weapon's operator. The momentum of the weapon may govern its recoil.

Figure 3:
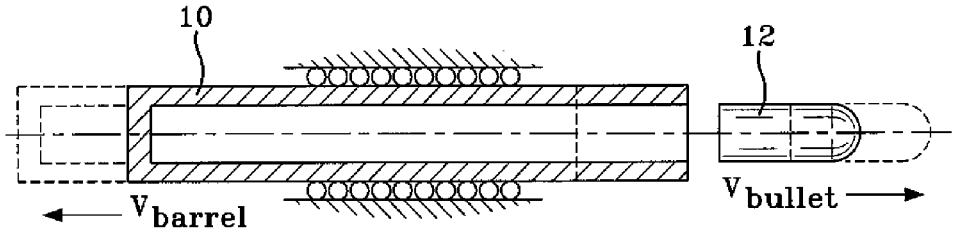
FIG. 3 schematically shows the motion of a translating barrel.

FIG. 3 schematically shows the motion of a translating barrel 10. When a projectile 12 is fired from a sliding barrel 10, virtually all of the velocity (and, subsequently, momentum) of the projectile 12 may be transferred to the barrel 10. Barrel 10 may be allowed to translate, and barrel 10 may be connected to counterweights in such a manner that both the barrel 10 and the counterweights impact the weapon's receiver at the same time. Thus, the momentum and impulse of the impacting masses may cancel each other and impart no impulse or momentum to the weapon operator (no recoil produced).

It is important that the mass of the two counterweights each be equal to or substantially equal to half the mass of the translating barrel. That is, in FIG. 2, if the ball A represents the barrel 10, the mass of each ball C may be one half the mass of the ball A. It is also important that the speeds of the two counterweights be equal to or substantially equal to the speed of the translating barrel 10. Furthermore, the counterweights and the translating barrel 10 may impact the receiver at substantially the same time.

Figure 4A:
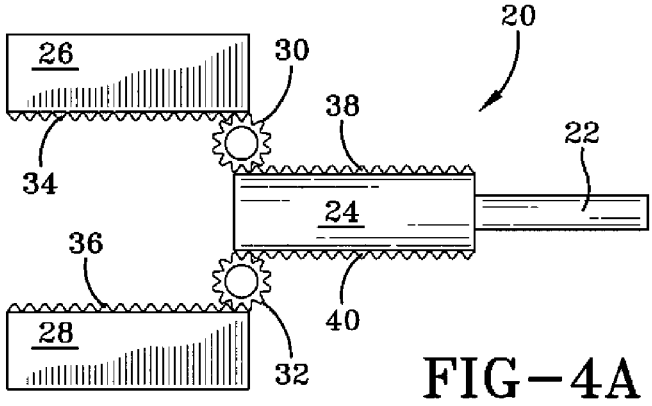
FIGS. 4A and 4B schematically show a two-dimensional recoil-mitigating kinematic chain.
Figure 4B:
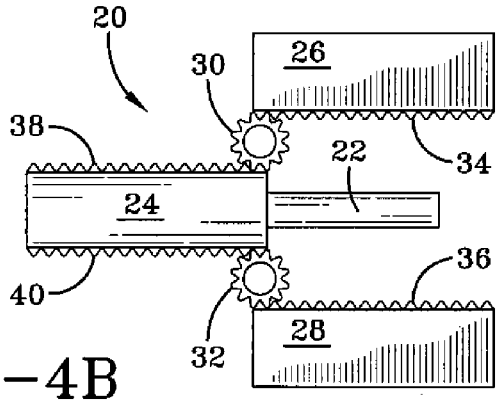

FIGS. 4A and 4B schematically show a two-dimensional recoil-mitigating kinematic chain. FIG. 4A shows positions of the components before firing and FIG. 4B shows positions of the components upon impact with the weapon's receiver. A translating block 20 may include a breech 24 and barrel 22. A pair of translatable counterweights 26, 28 may be disposed on opposite sides of sliding block 20. Each translatable counterweight 26, 28 may include respective racks 34, 36 that may engage respective pinions 30, 32. Translating block 20 may include racks 38, 40 that may engage respective pinions 30, 32.

The kinematic chain shown in FIGS. 4A and 4B has only one degree of freedom. As illustrated in FIG. 4, the translating block 20 may travel rearward upon firing. The rearward motion of the translating block 20 may compel the forward motion of the translating counterweights 26, 28 through the rack and pinion system. The rack and pinion system may maintain the velocities and impact timing of the translating block 20 and the counterweights 26, 28.

Figure 5A:
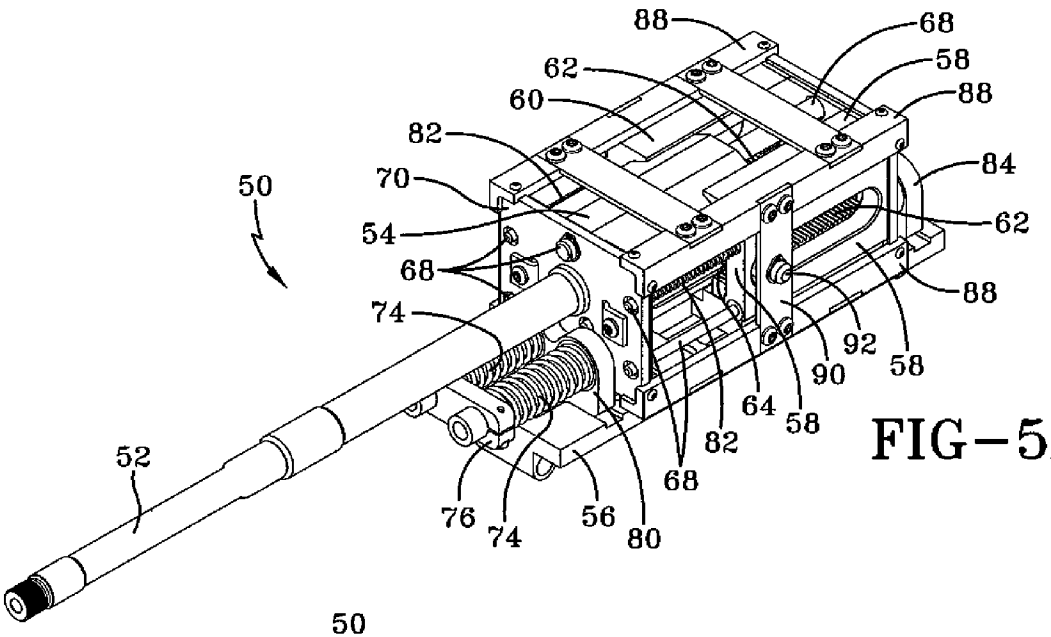
FIGS. 5A and 5B are perspective and side views, respectively of an embodiment of a weapon with a recoil mitigating device.
Figure 5B:
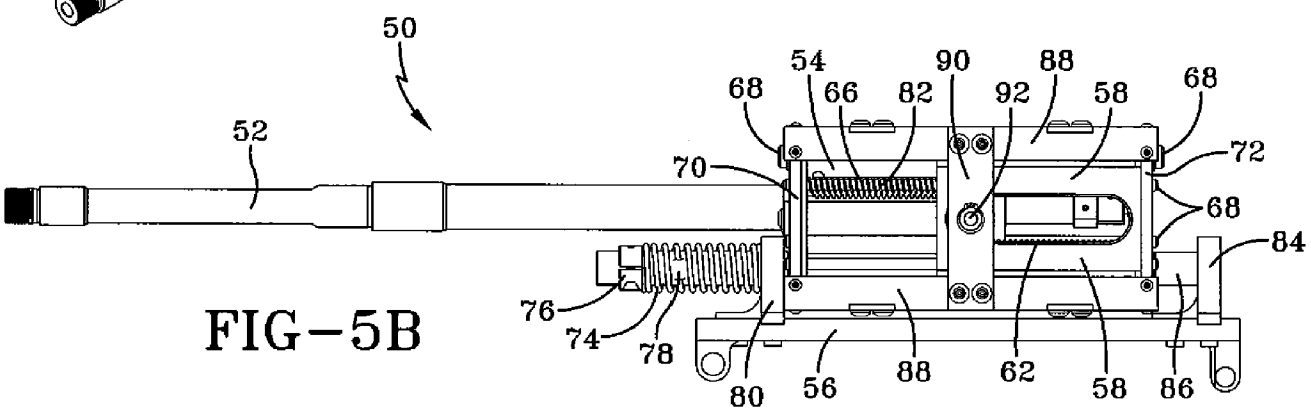

FIGS. 5A and 5B are perspective and side views, respectively of an embodiment of a weapon 50 with a recoil mitigating device. Weapon 50 may include a translatable recoil mass, for example, a barrel 52 and a barrel block 54. A pair of translatable counterweights 58, 60 may be disposed on opposite sides of the recoil mass. Each counterweight 58, 60 may have a mass that is substantially one-half a mass of the recoil mass. The directions of translation of the recoil mass are substantially opposite the directions of translation of the two counterweights 58, 60. A receiver 56 may be fixed with respect to the recoil mass and the pair of counterweights 58, 60.

The recoil mass and the counterweights 58, 60 may be engaged with each other via a rack and pinion arrangement. Racks 62, 62 may be fixed to respective ones of the counterweights 58, 60. A second pair of racks 66, 66 (only one rack 66 is visible in FIGS. 5A and B) may be fixed to opposites sides of the translatable recoil mass, for example, the barrel block 54. A pair of pinions 64, 64 (only the pinion 64 that engages counterweight 58 is visible in FIG. 5A) may engage a respective counterweight rack 62 and a recoil mass rack 66.

Barrel block 54 and counterweights 58, 60 may be supported by, and slidable on, mounting rods 68. Mounting rods 68 may extend between and may be fixed to a front plate 70 and a rear plate 72. Side members 88 may be extend between and may be fixed to the front plate 70 and the rear plate 72. Pinion mounts 90 (one mount 90 on each side) may support the rotatable shaft 92 of a pinion 64.

The receiver 56 may include front and rear flanges 80, 84. A pair of cylinders 78 may be fixed to the front plate 70 and be slidable through front flange 80. An inertial spring 74 may be mounted on each cylinder 78. Spring 74 may bear against the front flange 80 and a spring clamp 76. Springs 74 may bear the initial inertial loading of the weapon 50 upon firing, by compressing against front flange 80 as spring clamp 76 moves rearward.

To ensure proper positioning of the counterweights 58, 60 and barrel block 54 prior to firing weapon 50, positioning springs 82 may be disposed on one or more mounting rods 68. In FIGS. 5A and 5B, positioning springs 82 are disposed on mounting rods 68 and bear against counterweights 58, 60, respectively, and the rear surface of front plate 70.

Rear flange 84 of receiver 56 may include a pair of cylinders 86. To allow movement of rear plate 72 with respect to rear flange 84, cylinders 86 may be fixed to rear plate 72 and may be slidable in rear flange 84, or, cylinders 86 may be fixed to rear flange 84 and may be slidable in rear plate 72.

A method of mitigating recoil in a weapon 50 may include moving a pair of counterweights 58, 60 in a direction substantially opposite a direction of movement of a recoil mass, such as barrel 52 and barrel block 54. The pair of counterweights 58, 60 each has a mass that is about one-half a mass of the recoil mass. The counterweights 58, 60 and the recoil mass move at substantially a same speed. The movement of the counterweights 58, 60 and the recoil mass may be controlled using pinions 64, 64 that may engage racks 62, 62 on the counterweights 58, 60 and racks 66, 66 on opposite side of the barrel block 54.

Figure 6:
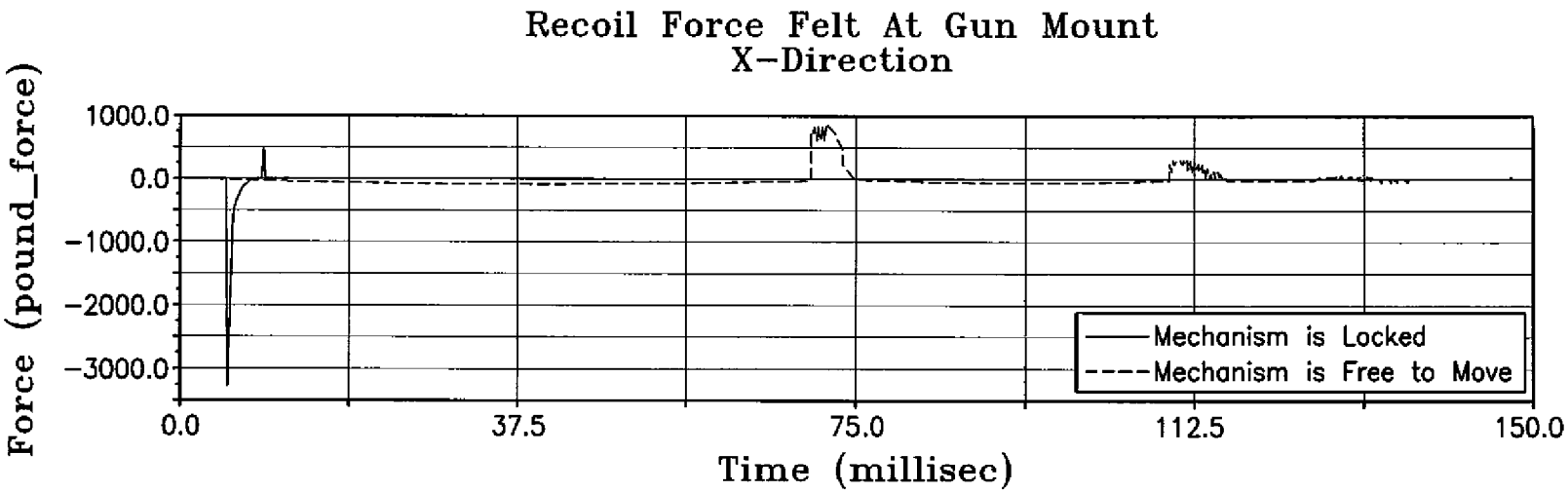
FIG. 6 is a plot of the single shot force versus time, with and without a recoil-mitigation kinematic chain.

Recoil was simulated using a computer model of the weapon 50. FIG. 6 is a plot of the single shot force versus time in a computer simulation, with and without a recoil mitigation kinematic chain. As seen in FIG. 6, the reduction in force response upon firing impact (from 0 to 37.5 milliseconds) is virtually 100% when the recoil mitigation kinematic chain is used.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A weapon, comprising:

a translatable recoil mass including a barrel and a barrel block;

two translatable counterweights disposed on opposite sides of the recoil mass, each counterweight having a mass that is substantially one-half a mass of the recoil mass;

a pair of racks fixed to respective ones of the counterweights, a second pair of racks fixed to opposites sides of the recoil mass, and a pair of pinions, each pinion engaging a counterweight rack and a recoil mass rack;

a receiver that is fixed with respect to the recoil mass and the pair of counterweights;

an inertial spring that transfers recoil force to the receiver;

wherein directions of translation of the recoil mass are substantially opposite direction of translation of the two counterweights; wherein the inertial spring transfers force by compressing against the receiver; a plurality of mounting rods having ends fixed to front and rear plates, wherein the recoil mass and the counterweights are slidable on respective ones of the mounting rods; and a positioning spring disposed on one of the mounting rods.

2. The weapon of claim 1, wherein the positioning spring bears against the front plate and one of the counterweights.

3. The weapon of claim 1, further comprising side members that are fixed to and extend between the front and rear plates.

* * * * *